US005920905A

United States Patent [19]

Aldridge

[11] Patent Number: 5,920,905

[45] **Date of Patent: *Jul. 13, 1999**

[54] FIREFIGHTER GARMENT WITH COMBINATION FACECLOTH AND MOISTURE BARRIER

[75] Inventor: Donald Aldridge, New Carlisle, Ohio

[73] Assignee: Lion Apparel, Inc., Dayton, Ohio

[ * ] Notice: This patent is subject to a terminal disclaimer.

[21] Appl. No.: 08/852,432

[22] Filed: May 7, 1997

Related U.S. Application Data

[60] Division of application No. 08/433,081, May 3, 1995, Pat. No. 5,640,718, which is a continuation-in-part of application No. 08/151,408, Nov. 12, 1993, Pat. No. 5,539,928.

[51] Int. Cl.[6] ..... A41D 13/00

[52] U.S. Cl. ..... 2/81; 2/97; 2/458

[58] Field of Search ..... 2/81, 82, 86, 87, 2/97, 272, 458, 79

[56] References Cited

U.S. PATENT DOCUMENTS

| | | | |
|---|---|---|---|
| 2,976,539 | 3/1961 | Brown, Jr. . | |
| 4,034,417 | 7/1977 | Ellis | 2/81 |
| 4,141,082 | 2/1979 | Nakazawa et al. | 2/93 |
| 4,179,752 | 12/1979 | Fackelmann | 2/2 |
| 4,287,608 | 9/1981 | Meyer | 2/16 |
| 4,494,247 | 1/1985 | Kelly | 2/24 |
| 4,662,006 | 5/1987 | Ross, Jr. | 2/158 |
| 4,843,646 | 7/1989 | Grilliot et al. | 2/69 |
| 4,945,571 | 8/1990 | Calvert | 2/2 |
| 5,014,354 | 5/1991 | Dumont | 2/23 |
| 5,131,097 | 7/1992 | Grilliot et al. | 2/81 |
| 5,136,723 | 8/1992 | Aldridge et al. | 2/81 |
| 5,189,737 | 3/1993 | Ribicic | 2/93 |
| 5,198,280 | 3/1993 | Harpell et al. | 428/102 |
| 5,202,086 | 4/1993 | Baliga et al. | 428/225 |
| 5,246,782 | 9/1993 | Kennedy et al. | 428/421 |
| 5,274,849 | 1/1994 | Grilliot et al. | 2/81 |
| 5,297,295 | 3/1994 | Barbeau et al. | 2/96 |
| 5,299,602 | 4/1994 | Barbeau et al. | 139/420 |
| 5,323,815 | 6/1994 | Barbeau et al. | 139/420 |
| 5,483,703 | 1/1996 | Williams | 2/87 |
| 5,499,663 | 3/1996 | Barbeau et al. | 139/420 |
| 5,539,928 | 7/1996 | Aldridge | 2/81 |
| 5,697,101 | 12/1997 | Aldridge | 2/81 |

FOREIGN PATENT DOCUMENTS

| | | |
|---|---|---|
| 1056553 | 6/1979 | Canada . |
| 57-171755 | 10/1982 | Japan . |
| 59-026547 | 2/1984 | Japan . |
| 1162838 | 6/1989 | Japan . |

OTHER PUBLICATIONS

Globe Catalog at p. 2; 1980.

*Primary Examiner*—Diana L. Oleksa
*Attorney, Agent, or Firm*—Thompson Hine & Flory LLP

[57] ABSTRACT

A firefighter garment which includes an outer shell, a thermal layer and a combination moisture barrier and facecloth. In the preferred embodiment, the combination moisture barrier and facecloth layer includes a semi-permeable component, such as polytetrafluoroethylene, which is attached to a facecloth material of a high lubricity filament yarn. The semi-permeable component functions as a moisture barrier and the filament yarn component provides a low friction interface between the garment and its wearer, thereby reducing heat stress imposed on the wearer of the garment during firefighting activity. The filament component also functions as a substrate for the moisture barrier. In the preferred embodiment, the thermal liner includes a layer of apertured flame and heat resistant unicellular or closed cell foam which is positioned between the outer shell and the combination moisture barrier and facecloth. The foam also has a substrate of low-friction woven or knit filament material which faces the outer shell to reduce friction between the outer shell and the thermal liner.

13 Claims, 1 Drawing Sheet

FIREFIGHTER GARMENT WITH COMBINATION FACECLOTH AND MOISTURE BARRIER

This is a divisional of application Ser. No. 08/433,081 filed May 3, 1995 now U.S. Pat. No. 5,640,718, which is a continuation-in-part of application Ser. No. 08/151,408 filed Nov. 12, 1993 now U.S. Pat. No. 5,539,928.

BACKGROUND OF THE INVENTION

The present invention relates to garments for wear in hazardous environments and, more particularly, to firefighter garments.

In order to meet applicable standards, a firefighter garment must withstand certain levels of abrasion, heat and moisture. Typically, these requirements have been met by providing a firefighter garment having an outer shell made of a heat and flame resistant aramid fiber such as NOMEX (a trademark of E.I. DuPont de Nemours & Co., Inc.), a moisture barrier positioned within and adjacent to the outer shell and a thermal liner, typically made of a batting of aramid fiber quilted to a woven facecloth of spun yarn fiber and positioned within and adjacent to the moisture barrier. Originally, the moisture barrier was made of a fabric coated with a neoprene rubber compound which made the moisture barrier impermeable to moisture vapor as well as liquid vapor.

However, moisture barriers are now available which comprise a layer of a semi-permeable membrane material such as GORE-TEX (a registered trademark of W. L. Gore & Associates, Inc.) adhesively attached to a substrate of an aramid fiber. Such moisture barriers are impermeable to liquid moisture but allow moisture vapor to pass through.

A disadvantage with such conventional firefighter garment construction is that, when worn, the rigors of firefighting activity results in a build up of excessive levels of moisture vapor from perspiration of the wearer. The flow of such moisture vapor through the semi-permeable moisture barrier membrane is impeded somewhat by the presence of the thermal liner material between the wearer and the moisture barrier. Collection of moisture from the wearer in the thermal liner has been found to reduce the thermal protective qualities of the thermal liner.

Another disadvantage of such conventional firefighter garments is that the necessity of placing the moisture barrier outside the thermal liner, between the thermal liner and outer shell, exposed the moisture barrier to heat penetrating the garment before the heat reached the thermal liner. Consequently, such moisture barriers would be prone to damage and degradation from exposure to heat.

This disadvantage has been overcome by substituting a low or non-absorbent material, such as an apertured, unicellular or closed cell foam laminate for the traditional fabric batting thermal liner. Such closed cell foams, which are heat and flame-resistant, do not themselves absorb outside source moisture from hoses or foul weather, as do conventional woven or fibrous thermal liners, so that they may be placed outside of the moisture barrier, between the moisture barrier and outer shell. This orientation protects the moisture barrier from heat damage, reducing the cost of repairs to the garment, since the moisture barrier is often the most expensive and delicate component in the liner system. It is neither practical nor desirable to place conventional thermal liners outside the moisture barrier since such thermal liners would absorb moisture and add to the weight of the garment. Such non-absorbent thermal liners are disclosed in commonly-owned copending application Ser. No. 119,474, filed Sep. 10, 1993, the disclosure of which is incorporated herein by reference.

A known practice in the industry is the reduction of stress experienced by the wearer of a firefighter garment resulting from the effort required to overcome the frictional engagement of the wearer's clothing with the interior layer of the garment during wearer movement by providing a "slippery" facecloth between the wearer and the thermal barrier of the garment. Such a slippery facecloth also facilitates the donning and doffing of the garment. The facecloth is made of a filament yarn woven or knit into woven or knitted fabric preferably composed of an aramid fiber such as NOMEX. However, such firefighter garments having a filament facecloth still embody the traditional orientation of an outer shell covering a moisture barrier which, in turn covers a thermal liner.

As a result, such firefighter garments include three distinct layers: an outer shell, a moisture barrier consisting of a semi-permeable membrane bonded or laminated to a fabric substrate and a thermal liner positioned within the moisture barrier and quilted to a facecloth. Accordingly, there is a need to provide a firefighter garment having the benefits of a non-moisture absorbent thermal liner with the stress reduction and increased work efficiency of garments with filament layers:

SUMMARY

The present invention is a firefighter garment which has minimal weight, provides sufficient moisture and thermal protection to meet all applicable standards, including the N.F.P.A. 1971 Standard, and yet provides optimal moisture vapor transport outwardly from the wearer while reducing the effort required—and energy required—to move while wearing the garment, including donning and doffing the garment. The firefighter garment is unique in that it has combined a moisture barrier and low-friction facecloth into a single layer. Consequently, it places the semi-permeable moisture barrier substrate closer to the wearer's skin and is additionally unique since the moisture barrier substrate is made of lower friction yarns of multifilament high heat resistant fiber such as NOMEX. In both instances, the result is a combination moisture barrier facecloth.

A firefighter garment embodying the present invention includes an outer shell, a non-absorbent thermal liner positioned adjacent to the outer shell, and a combination moisture barrier and low-friction facecloth. Consequently, such a garment efficiently combines the benefits of placing the moisture barrier adjacent to the wearer and provides a low-friction filament facecloth to reduce wearer stress and facilitate donning and doffing of the garment.

In a preferred embodiment of the invention, the thermal liner comprises a layer of apertured, closed cell foam which is bonded to a layer of facecloth fabric, the combination being sufficiently flame and heat resistant to meet applicable N.F.P.A. Standards. Such a thermal liner absorbs substantially less moisture than conventional thermal liners and therefore can be positioned outside the moisture barrier and within the outer shell because it reduces wet weight gain from sources of moisture outside the garment. The combination moisture barrier facecloth comprises a woven or knit of spun or filament yarn which is bonded or laminated to a semi-permeable membrane material such as polytetrafluoroethylene ("PTFE") film/membrane or polyurethane ("PU") film/membrane.

The combined moisture barrier and facecloth of the present invention performs two functions. First, it provides a moisture barrier which prevents liquid moisture from flowing inwardly through the garment to the wearer, and yet promotes moisture vapor transport generated by evaporation of the wearer's perspiration outwardly from the wearer. Secondly, (when the filament yarn is used) the layer provides a lower friction facecloth which reduces wearer stress. Consequently, the low friction filament component of the combination moisture barrier facecloth performs a double duty: it provides a substrate which protects and supports the moisture barrier membrane, and acts as a low-friction facecloth interface between the wearer and the garment. When compared to prior art garments, the ensemble of the present invention increases the exposure time for a wearer to sustain a second degree burn by reducing body-generated wet weight gain which occurs in such traditional systems, and reduces heat stress because the permeable membrane is closer to the wearer and enhances comfort.

In another preferred embodiment of the invention, the thermal liner comprises a layer of flame and heat resistant, closed-cell apertured foam bonded to a substrate comprised of a low-friction filament yarn. The thermal liner is oriented in the garment such that the filament substrate faces the outer shell. This interface between the outer shell and the thermal liner further reduces the effort required to move while wearing the garment since it reduces the friction between the outer shell and the adjacent thermal liner. This embodiment also includes the combined moisture barrier and facecloth of low friction filament fabric to reduce friction between the wearer and the garment.

Accordingly, it is an object of the present invention to provide a combined moisture barrier and/or low-friction facecloth which meets applicable NFPA standards; a combined moisture barrier and facecloth which reduces friction between the wearer and the associated garment, thereby reducing wearer stress and fatigue and facilitating donning and doffing of the garment; a firefighter garment having minimal weight; a firefighter garment having a moisture barrier which comprises a semi-permeable membrane bonded to a substrate that functions as a protective facecloth; a firefighter garment which minimizes friction between the outer shell and the adjacent thermal liner layers; and a firefighter garment which is relatively low in cost and relatively easy to maintain.

Other objects and advantages of the present invention will be apparent from the following description, the accompanying drawings and the appended claims.

DETAILED DESCRIPTION

Figure 1:
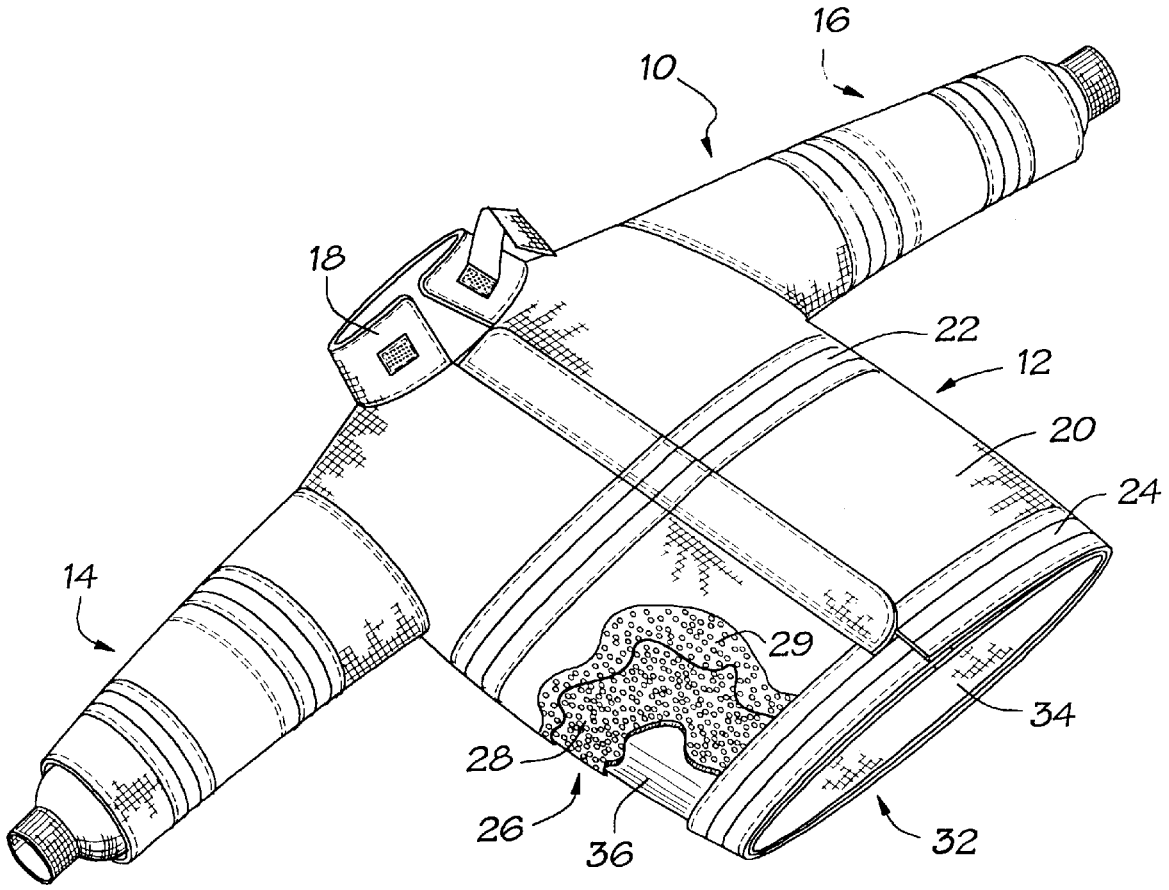
FIG. 1 is a perspective view of a firefighter turnout coat embodying the present invention.

As shown in FIG. 1, the preferred embodiment of the present invention is in the form of a firefighter turnout coat, generally designated 10, having a body portion 12, sleeves 14, 16 and collar 18. It is within the scope of the present invention to provide a complementary pant (not shown), having a similar construction.

Figure 2:
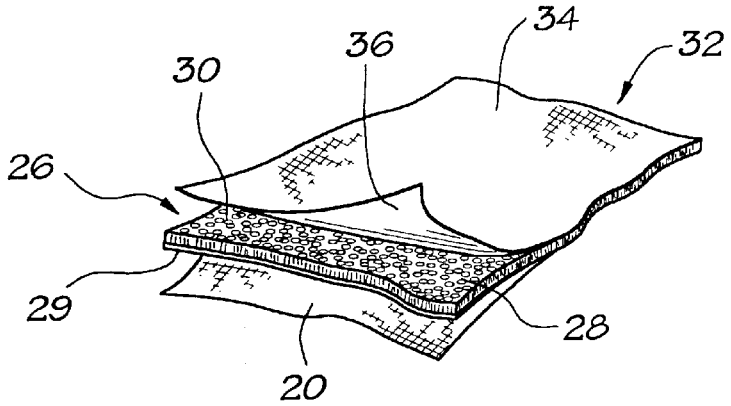
FIG. 2 is a detail of the firefighter coat of FIG. 1, showing the layers of the garment.

The body 12 and sleeves 14, 16 are covered by an outer shell 20 (see also FIG. 2) of a flame and heat resistant aramid fiber such as NOMEX or KEVLAR (a trademark of E.I. DuPont de Nemours & Co., Inc.). The outer shell 20 is of conventional design, and may include bands 22, 24 of reflective material stitched to the outer surface of the outer shell.

A thermal liner 26 is positioned within the outer shell and comprises a layer of an apertured closed cell foam material 28 adhesively bonded to a substrate 29 of a woven or knit fabric of spun or filament yarns. The yarn preferably is made of a flame and heat resistant material such as an aramid fiber. Preferred aramid fibers are NOMEX and KEVLAR. The substrate 29 preferably is attached to the layer of apertured, closed cell foam by a suitable adhesive. In the alternative, the composite foam 28 and substrate 29 are first bonded together by an adhesive, then the composite perforated to form the apertured liner 26. The liner 26 is oriented within the garment 10 such that the substrate 29 faces the outer shell 20.

The layer of foam material 28 preferably is between 3/32 and 1/8 inches thick and made of a flame and heat resistant unicellular foam, such as ENSOLITE Styles IV1, IV2, IV3, IV4, IV5, GIC or IVC, all manufactured by Ensolite, a Division of Uniroyal Technology Corp. of Mishawaka, Ind. Such closed cell foams include foams made of polyvinyl and nitrile rubber combined with other ingredients to give them high heat resistance. Although all of the components of the garment 10 provide some minimal insulative function, the layer of foam material 28 performs the primary insulative function of the garment.

The thermal liner 26 may be bonded adhesively to the outer shell 20 by conventional means, such as by a pattern or matrix of adhesive dots (not shown) of a suitable heat-resistant adhesive, positioned so that a minimum number of apertures 30 of the layer 26 are blocked, or by lines or webs of such adhesive. In such an embodiment, the thermal liner would not have the substrate 29 of low-friction material. Alternately, the thermal liner 26 is not attached to the outer shell, but may be removable to facilitate separate cleaning of the outer shell and liner system. The apertured closed cell foam thermal liner 26 is described in greater detail in co-pending application Ser. No. 119,474, filed Sep. 10, 1993, the disclosure of which is incorporated herein by reference.

The garment 10 also includes a combination moisture barrier and facecloth layer 32. Layer 32 comprises a facecloth 34 made of a flame and heat resistant filament yarn, such as NOMEX material. Other acceptable materials for the facecloth component 34 are a combination of filament and spun yarns, 100% multifilament yarns or 100% spun yarns, or a permanently chemically or mechanically altered fabric substrate having the desired degree of lubricity. The facecloth component 34 preferably is a plain weave woven fabric, which is relatively light, but a twill weave or knit fabric may be used since both provide less contact surface per unit area than plain weaves. A moisture barrier material 36 is adhesively bonded to the facecloth layer 34 by a matrix of dots of heat-resistant adhesive (not shown). The moisture barrier material 36 preferably is a PTFE film such as GORE-TEX.

In an alternate embodiment, the moisture barrier component 36 is bonded to the facecloth component 34 by lines or webs of heat resistant adhesive (not shown). Also, the moisture barrier component 36 can be coated or cast onto the substrate facecloth component 34, which provides a mechanical as well as chemical attachment.

The thermal liner 26 and combination facecloth and moisture barrier 32 are continuous throughout the garment; that is, these layers extend throughout the body 12 and sleeves 14, 16 of the garment to provide thermal and moisture protection. Further, the combination facecloth and moisture barrier material presents a high lubricity surface to the wearer. This high lubricity surface reduces the friction between the clothing of the wearer and the garment 10. In addition, the filament substrate 29 of the thermal layer 26 reduces friction between the outer shell and the thermal layer. This reduction in friction reduces the garment's resistance to movement by the wearer, and thus the effort required to perform movements while wearing the garment 10 is reduced, and which reduces the energy required to perform specific tasks. This energy reduction, when it occurs during harsh firefighting conditions, reduces the stress imposed on a wearer.

Consequently, the resulting garment 10 comprises an outer shell 20, thermal barrier layer 26 and combination moisture barrier/facecloth layer 32. The combined moisture barrier/facecloth layer 32 performs the double duty of protecting the waterproof breathable film components of the garment from abrasion by the clothing of the wearer by virtue of the high lubricity component 34 of the layer 32, and the same component 34 acts as a substrate for the moisture barrier 36. The ability in the present invention to combine the moisture barrier/facecloth is made possible by providing a low or nonabsorbent material for the thermal liner, such as the closed cell apertured foam thermal liner 26, which can be placed between the moisture barrier 36 and outer shell 20. Moisture vapor transport from the wearer through the garment to the ambient environment is enhanced with the embodiment of the present invention.

In contrast with prior art garments in which the moisture barrier is between the thermal liner and the outer shell, the proximity of the moisture barrier 36 (it is only separated from the wearer by the facecloth component 34) maximizes moisture vapor transport rate through the moisture barrier. The apertures 30 in the thermal liner 26 enable the moisture vapor which has passed through the moisture barrier 36 to pass through the thermal liner to the outer shell 20, where it enters the ambient environment.

While the forms of apparatus herein described constitute preferred embodiments of the invention, it is understood that the present invention is not limited to these precise forms of apparatus, and that other forms may be employed without departing from the scope of the invention.

What is claimed is:

1. A firefighter garment comprising:

a body segment adapted to cover and protect a portion of a wearer's body, said body segment including a combination moisture barrier and facecloth liner, said combination moisture barrier and facecloth liner including, (a) a moisture barrier component including a semi-permeable membrane material; and (b) a filament fabric component having a relatively high lubricity attached to said moisture barrier component;

said combination moisture barrier and facecloth liner being oriented within said body segment such that said fabric component is an innermost layer of the firefighter garment and is thereby adapted to be immediately adjacent to and facing a wearer of said garment.

2. A method of manufacturing a combination facecloth and moisture barrier for use with a firefighter garment, comprising the steps of:

selecting a flame and heat resistant woven or knit filament yarn material;

bonding said filament yarn material to a waterproof, semi-permeable material; and forming said bonded material to fit within a firefighter garment such that the filament material faces and is immediately adjacent to a wearer of said garment.

3. The method of claim 2 wherein said filament material is an aramid fiber.

4. The method of claim 2 wherein said moisture barrier material is coated on said filament material.

5. The method of claim 2 wherein said moisture barrier material is adhesively bonded to said filament material.

6. A garment comprising:

a combination moisture barrier and facecloth layer including a component of a moisture barrier material and a fabric component having a surface of relatively high lubricity, wherein said combination moisture barrier and facecloth layer is positioned within said garment such that said fabric component is immediately adjacent to a wearer of said garment.

7. The combination moisture barrier and facecloth layer of claim 6 wherein said fabric component is made of a flame and heat resistant material.

8. The combination moisture barrier and facecloth layer of claim 7 wherein said flame and heat resistant material is an aramid fiber.

9. A method for manufacturing a garment comprising the steps of:

providing a body segment portion adapted to cover a portion of a wearer's body;

bonding a fabric component to a component of a moisture barrier material, so as to form a combination moisture barrier and facecloth; and orienting said combination moisture barrier and facecloth within said body segment such that the fabric material is an innermost layer of the garment and thereby is adapted to face and be immediately adjacent to a wearer of the garment;

wherein said fabric component is an aramid fiber.

10. The method of claim 9 wherein said moisture barrier material is adhesively bonded to said fabric component.

11. A method for manufacturing a garment comprising the steps of:

providing a body segment portion adapted to cover a portion of a wearer's body;

bonding a fabric component to a component of a moisture barrier material, so as to form a combination moisture barrier and facecloth; and orienting said combination moisture barrier and facecloth within said body segment such that the fabric material is an innermost layer of the garment and thereby is adapted to face and be immediately adjacent to a wearer of the garment;

wherein said moisture barrier material is coated on said fabric component.

12. For use with a firefighter garment, a combination moisture barrier and facecloth liner comprising:

a moisture barrier component including a semi-permeable membrane material;

a filament fabric component having a relatively high lubricity attached to said moisture barrier component, said fabric component being made of a flame and heat resistant material; and said combination moisture barrier and facecloth liner being shaped to fit within a firefighter garment such that said fabric component is immediately adjacent to and faces a wearer of said garment.

13. The combination moisture barrier and facecloth component of claim 12 wherein said flame and heat resistant material is an aramid fiber.

* * * * *